US005500978A

United States Patent [19]

Levine

[11] Patent Number: 5,500,978

[45] Date of Patent: Mar. 26, 1996

[54] VACUUM CLEANER APPARATUS AND DISPOSABLE BAG FOR SAME

[76] Inventor: Morris M. Levine, 109 Donnybrook Rd., Scarsdale, N.Y. 10583

[21] Appl. No.: 133,673

[22] Filed: Oct. 8, 1993

[51] Int. Cl.[6] ..... A47L 9/14

[52] U.S. Cl. ..... 15/347; 15/344; 15/350; 15/352

[58] Field of Search ..... 15/344, 347, 350, 15/352

[56] References Cited

U.S. PATENT DOCUMENTS

| | | | |
|---|---|---|---|
| 1,084,933 | 1/1914 | Feeny | 15/344 X |
| 1,130,114 | 3/1915 | Small | 15/344 X |
| 4,279,095 | 7/1981 | Aasen | 15/402 X |
| 4,718,140 | 1/1988 | Johnson | 15/344 X |

FOREIGN PATENT DOCUMENTS

| | | | |
|---|---|---|---|
| 1147360 | 4/1963 | Germany | 15/344 |
| 2137896 | 10/1984 | United Kingdom | 15/344 |

*Primary Examiner*—Christopher K. Moore
*Attorney, Agent, or Firm*—William E. Noonan

[57] ABSTRACT

A vacuum cleaner apparatus is disclosed, including a housing and a blower disposed in the housing. There is a power source for driving the blower and a substance collection container is detachably engaged with the housing and includes an inlet portion formed therein. A suction section extends generally between the blower and the substance collection container and includes a first port disposed in the container. An intake section is engaged with the inlet portion of the container and includes a second port disposed in the container. An actuator selectively connects the blower with the power source to operate the blower and opens the first and second ports to create a vacuum in the container such that the air and accompanying substances are drawn through the intake section into the container. The actuator also selectively disconnects the blower from the power source and closes the first and second ports to terminate air flow and restrict substance movement into and out of the container.

19 Claims, 8 Drawing Sheets

VACUUM CLEANER APPARATUS AND DISPOSABLE BAG FOR SAME

FIELD OF THE INVENTION

This invention relates to a vacuum cleaner apparatus and, more particularly, to a handheld vacuum cleaner and a disposable bag for the same.

RELATED APPLICATION

This application is a substitute for applicant's earlier application Ser. No. 07/635,717 filed Dec. 20, 1990 and now abandoned.

BACKGROUND OF INVENTION

Various portable wet-dry vacuum cleaners are currently available for cleaning both solid and liquid debris. However, these conventional machines typically exhibit one or more of a number of disadvantageous features.

Virtually all portable vacuum cleaners employ a permanent canister for collecting the vacuumed debris. Periodically, the collected debris must be emptied from the canister. This can be a messy, unsanitary and unpleasant task. The user must take particular care not to spill debris from the canister as it is emptied. Furthermore, if the canister is not cleaned after each use, it tends to exhibit an unpleasant odor and may become a breeding ground for insects and bacteria.

Difficulty has also been encountered in adequately protecting the motor, impeller and other moving parts of the vacuum cleaner against the various liquids and solids that are collected. Various models employ baffles, diverters and other mechanisms to block such debris from the moving parts. Nonetheless, typically a certain amount of debris still infiltrates the machine. Liquid is particularly likely to enter the blower of a hand-held vacuum cleaner if the unit is tipped or held vertically. Liquid reaching the motor or impeller can cause rusting and/or a short circuit, which can greatly reduce the life of the machine. Moreover, insects, germs and bacteria entering the moving parts can colonize and be quite difficult to eliminate. Although certain units have employed vents for discharging liquids from the blower units, such vents have generally proven to be unsatisfactory.

SUMMARY OF THE INVENTION

It is therefore an object of this invention to provide a vacuum cleaner apparatus that permits the collected debris to be stored and disposed of in a neat, clean and convenient manner.

It is a further object of this invention to provide a vacuum cleaner apparatus that completely segregates the collected debris from the moving parts of the machine when the machine is not in use so that improved protection is provided to the moving parts.

It is a further object of this invention to provide a vacuum cleaner apparatus that protects against the colonization of insects, bacteria and germs in the apparatus.

It is a further object of this invention to provide a vacuum cleaner apparatus that is particularly convenient for wet-dry cleaning applications and portable hand-held use.

It is a further object of this invention to provide a disposable bag that may be employed with a hand-held vacuum cleaner for quickly, conveniently and sanitarily disposing of collected debris.

This invention features a vacuum cleaner apparatus including a housing and blower means disposed in the housing. There is a source of power for driving the blower means. Substance collection container means are detachably engaged with the housing and include an inlet portion formed therein. A suction section extends generally between the blower means and the substance collection container means. The suction section includes first port means that are disposed in the container means. An intake section is engageable with the inlet portion of the container means and includes second port means that are disposed in the container means. There are actuator means for selectively connecting the blower means with the source of power to operate the blower means and opening the first and second port means to create a vacuum in the container means such that air and accompanying substances are drawn through the intake section into the chamber. The actuator means also selectively disconnect the blower means from the power source and close the first and second port means to terminate air flow into and restrict substance movement into and out of the container means.

In a preferred embodiment, the power source includes battery means disposed in the housing. The blower means may include an impeller and a motor that is energized by the power source to drive the impeller to create the vacuum in the container means. The container means may include a canister having a rearward end that is detachably engageable with the housing and a forward end through which the inlet portion is formed. The container means may further include a bag element that is received by the canister. The inlet portion may include a mouth element formed in and extending through a forward end of the bag. The mouth element may be releasably engageable with the intake section and a retaining element may engage a relatively rearward end of the bag and hold the bag generally open within the canister.

The suction section may include at least one inner suction tube that extends into the container means and may further include filter means for collecting solid substances that enters the suction section through the first port means from the container means. The first and second port means may include openings formed respectively in the suction section and the intake section.

The actuator may include a closure member that is slidably mounted on the intake section and the suction section and means may be provided for driving the closure member between a first portion uncovering the opening of the first and second port means and a second position covering those openings. The means for driving may include a switch assembly and means for operably connecting the switch assembly and the closure. This switch assembly may be alternately movable between a first state to urge the closure into the first position and a second state to urge the closure into a second position. The means for operably interconnecting may include resilient means for biasing the switch assembly into the first state and allowing the switch assembly to be moved into the second state. The switch assembly may include cam means and the means for operably interconnecting may include cam follower means that are engaged by the cam means. Means may further be provided for locking the switch assembly in the second state.

The switch assembly may include means for alternately interconnecting the power source and the blower means when the switch assembly is moved into the first state and disconnecting the blower means from the power source when the switch assembly is moved into the second state. The means for interconnecting and disconnecting may include a power switch that is interconnected between the power source and the blower means and an engagement member for engaging the power switch when the switch assembly is in the first state to connect the power source and the blower means and disengaging the power switch when the switch assembly is in the second state to disconnect the power source and the blower means. The container means may further include cover means for selectively covering the inlet portion. Such cover means may be attached to the mouth element and extend out of the canister through the inlet for selectively covering the inlet portion. The inlet portion may include a recess for selectively receiving at least a portion of the cover means.

An exhaust vent may extend from the blower means through the housing for exhausting air drawn in by the blower means when the blower means are operated.

This invention further features a substance collection bag for a hand-held vacuum cleaner apparatus that includes a housing, a selectively actuated blower, a canister that is detachably engaged with the housing and has an inlet formed therein, and a suction section interconnecting the blower means and the canister for developing a vacuum in the canister to draw air and debris in through the inlet when the blower means are activated. The bag includes a bag body that is received by and generally conforms to the interior shape of the canister. A leading end portion includes a first opening that communicates with the inlet of the canister. A trailing portion includes a second opening that communicates with the suction section such that a vacuum is created in the bag when the blower means are activated.

DESCRIPTION OF PREFERRED EMBODIMENTS

Other objects, features and advantages will occur from the following description of preferred embodiments and the accompanying drawings, in which.

Figure 1:
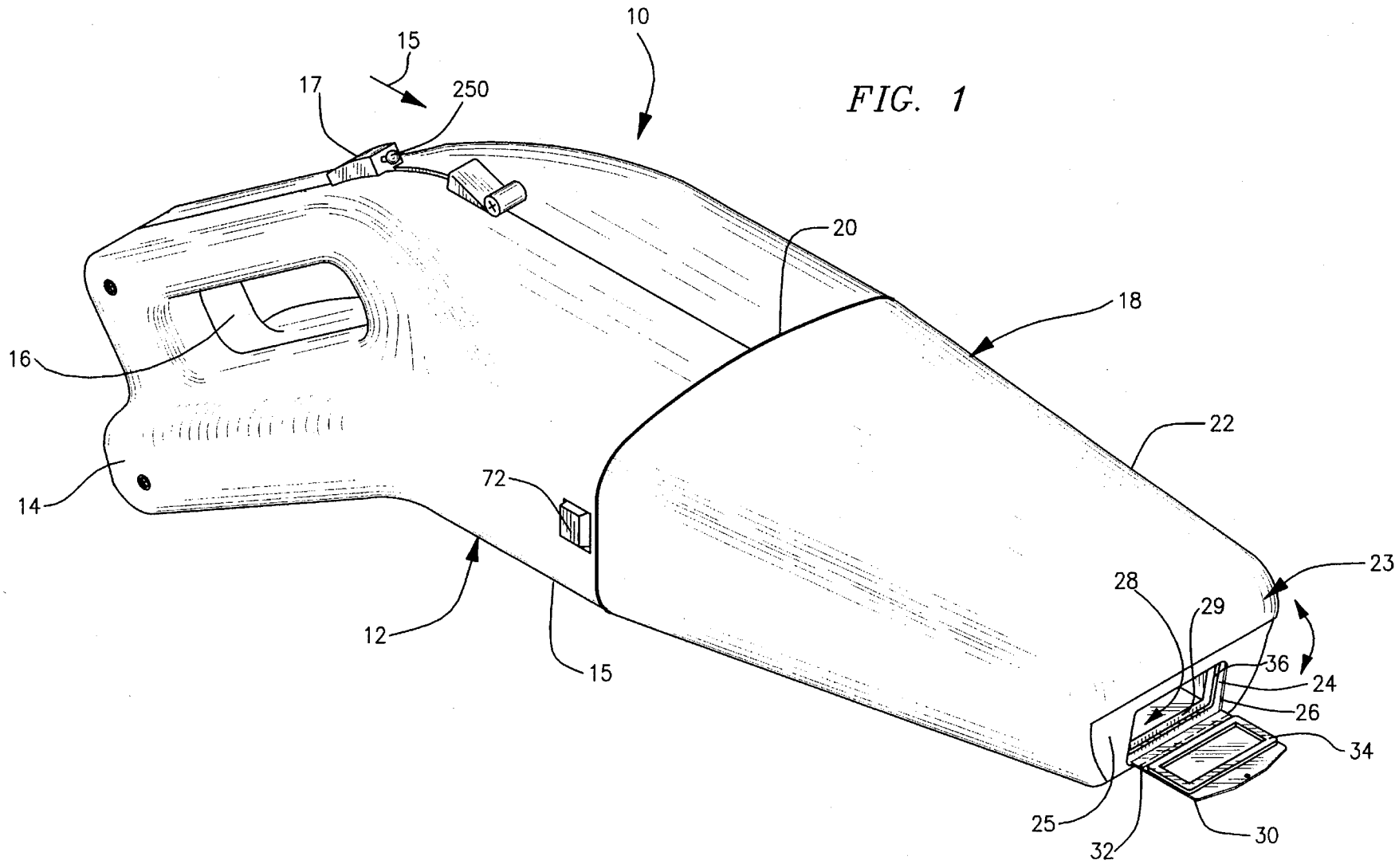
FIG. 1 is a perspective view of a vacuum cleaner apparatus according to this invention.
Figure 2:
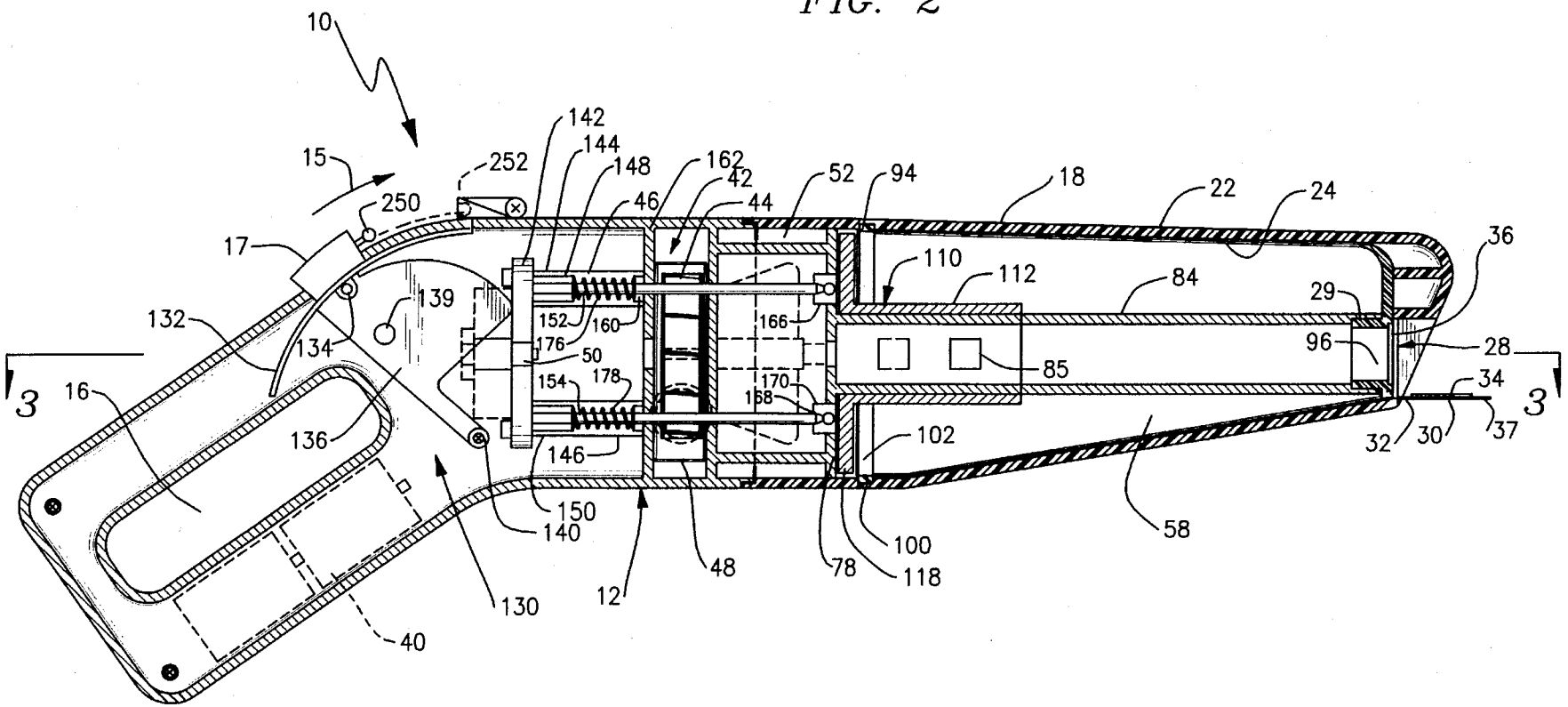
FIG. 2 is a side, elevational, cross sectional view of the vacuum cleaner apparatus taken along line 2—2 of FIG. 3.
Figure 3:
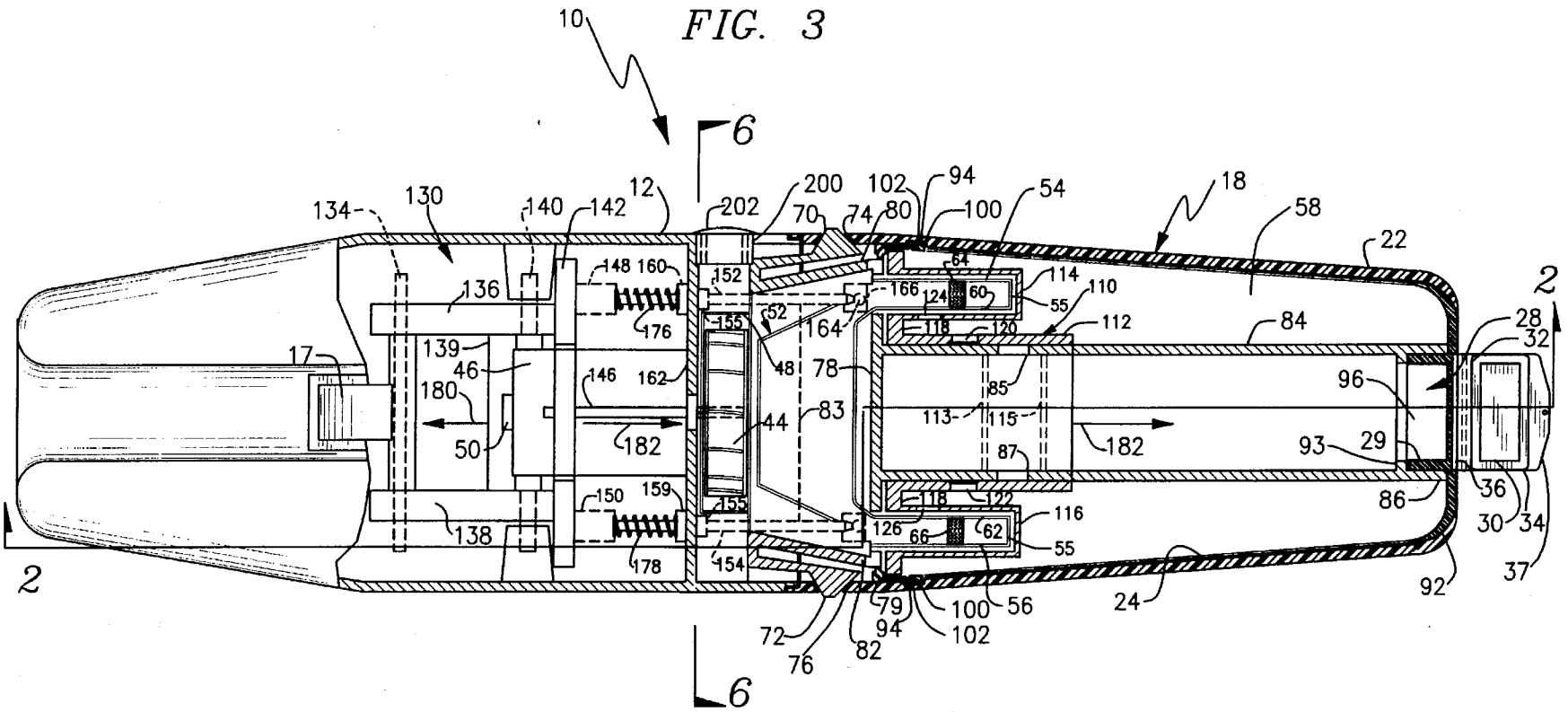
FIG. 3 is a cross sectional of the apparatus taken along line 3—3 of FIG. 2.
Figure 8:
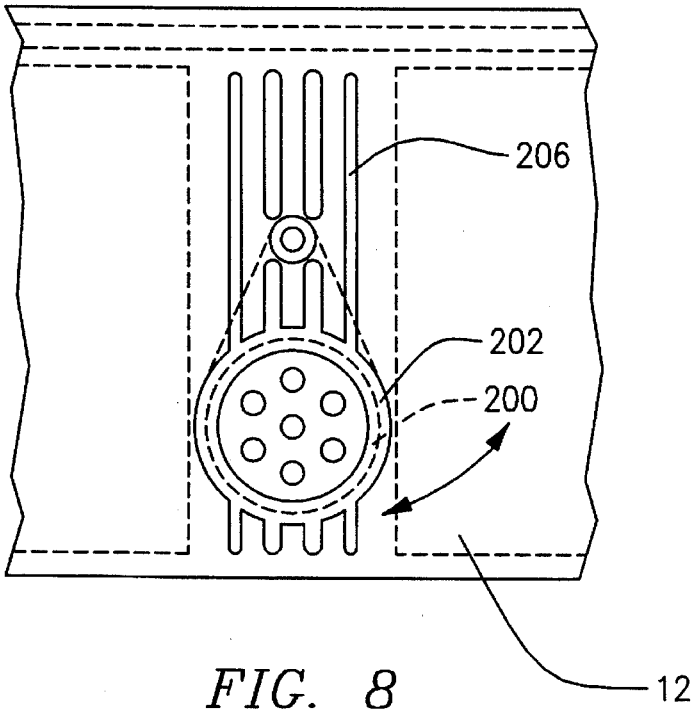
Figure 11:
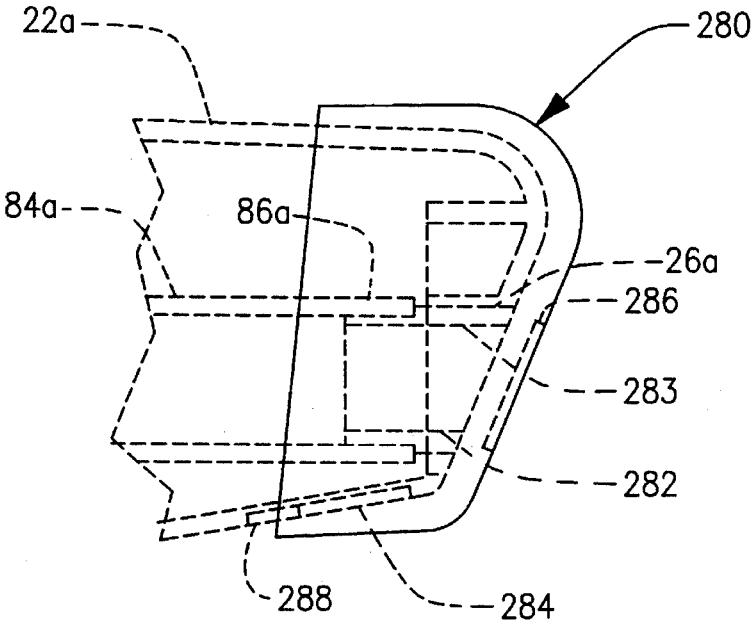
Figure 9:
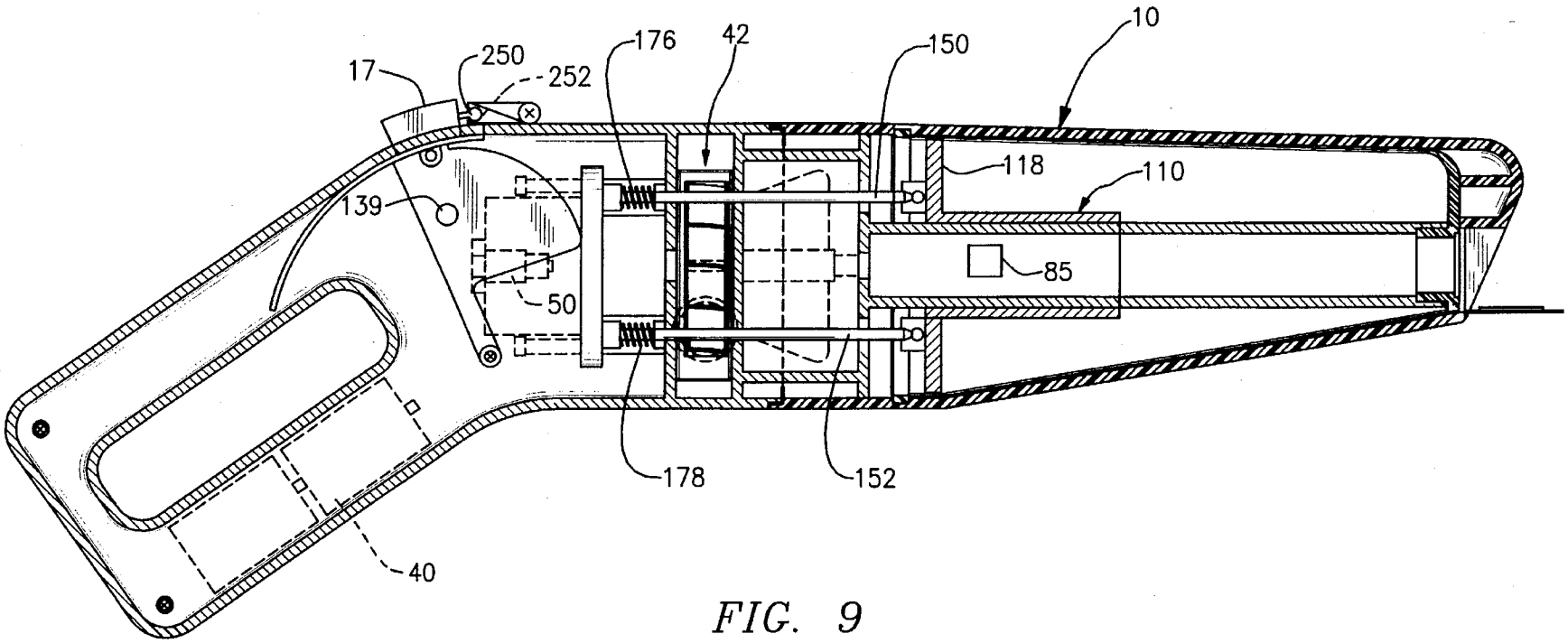
Figure 10:
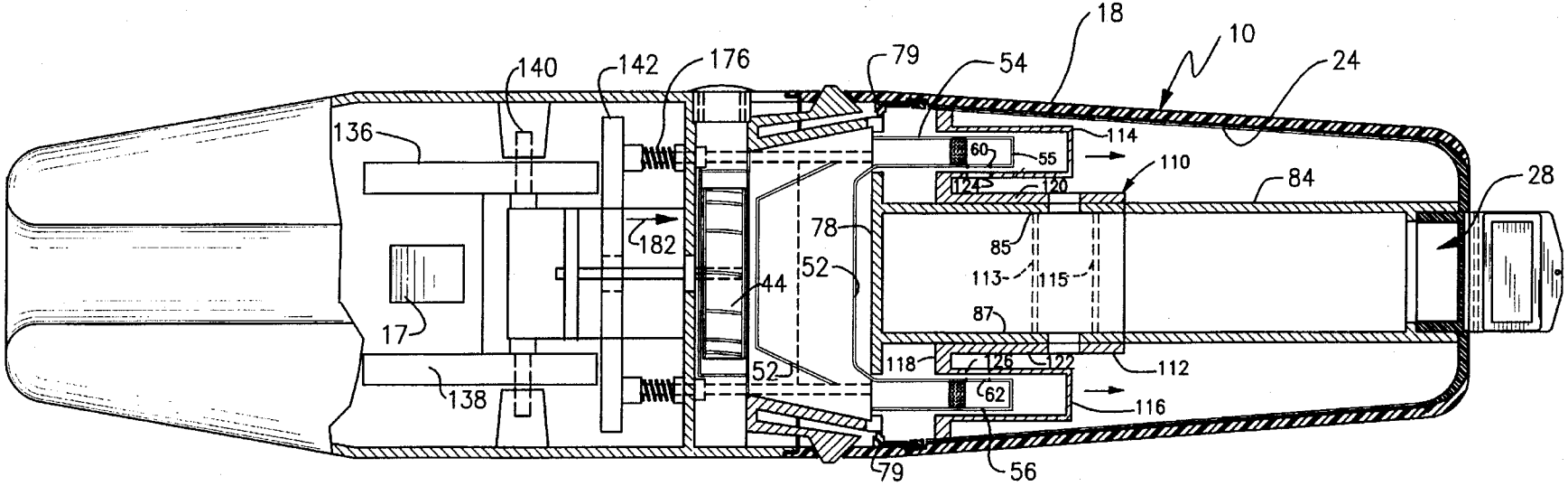

FIG. 8 an elevational view of the exterior of the exhaust vent;

FIG. 9 is a cross sectional view, similar to FIG. 2, illustrating the apparatus in an activated condition;

FIG. 10 is a cross sectional view, similar to FIG. 3, illustrating the apparatus in the activated condition; and FIG. 11 is an elevational side view of the forward end of the canister with an adapter cover attached thereto;

There is shown in FIG. 1 a hand-held, wet-dry vacuum cleaner apparatus 10 that includes a housing 12. A handle portion 14 formed at one end of housing 12 depends at an angle from the body 15 of the housing. An opening 16 is formed in handle portion 14 for accommodating the user's hand so that apparatus 10 may be held conveniently for cleaning. Housing 12 is preferably composed of a rugged, and yet light weight plastic material. Alternatively, various other materials such as metals, rubber, etc. may be employed.

A substance collection container 18 is detachably engaged to a forward end 20 of housing 12 and is provisionally locked onto the housing by clips 70 (FIG. 3) and 72. Container 18 includes an outer canister 22 that is preferably composed of a durable plastic or elastomeric material. Forward end 23 of canister 22 has an indented portion 25, in which is formed a rectangular slot 26. Canister accommodates a bag 24, which is barely visible around the edge of slot 26. Bag 24 includes a rectangular mouth element 29 that communicates with canister slot 26 to form an inlet portion 28 in container 18. A provisional cover 30 is attached to bag 24 by a flexible hinge 32. During operation of apparatus 10, cover 30 is left open, so that air and accompanying debris are drawn into container means 18. When the apparatus is not in use, cover 30 is folded upwardly and a peripheral rib 34 around the cover is engaged with a complementary recess 36 that is formed in mouth element 29. This holds the cover in place closed over the inlet so that collected material is held in container means 18.

A thumb switch element 17 is slidably mounted on housing 12. Element 17 is pushed forwardly in the direction of arrow 15 to start the vacuum cleaner. Apparatus 10 is deactivated by moving element 17 rearwardly to the position shown in FIG. 1. This entire operation is described more fully in connection with the remaining figures.

As shown in FIG. 2, apparatus 10 includes a power source 40 that comprises one or more batteries such as are conventionally used in the portable vacuum cleaner art. Power source 40 is selectively connected to and thereby energizes and drives a vacuum cleaner blower 42. The blower, FIGS. 2 and 3, includes a conventional vacuum cleaner impeller 44 and a motor 46 for driving impeller 44. The impeller is housed in a volute 48, also shown in FIG. 6. A power switch 50, which typically comprises a microswitch, is interconnected between power source 40 and motor 46. Power switch 50 serves to selectively activate the blower in the manner described more fully below.

A suction section 52 extends generally between blower 42 and container 18. More particularly, a rearward end of suction section 52 communicates with volute 48 and, as shown in FIG. 3, a pair of suction tubes 54 and 56 extend from the opposite end of the suction section into an interior chamber 58 formed in container 18. First port means are formed in each of the tubes 54 and 56. In particular an opening 60 is formed in the inside wall of tube 54 and a similar opening 62 is formed on the inside wall of tube 56. Filters 64 and 66 that are capable of trapping particulate matter are disposed in suction tubes 54 and 56, respectively.

Figure 4:
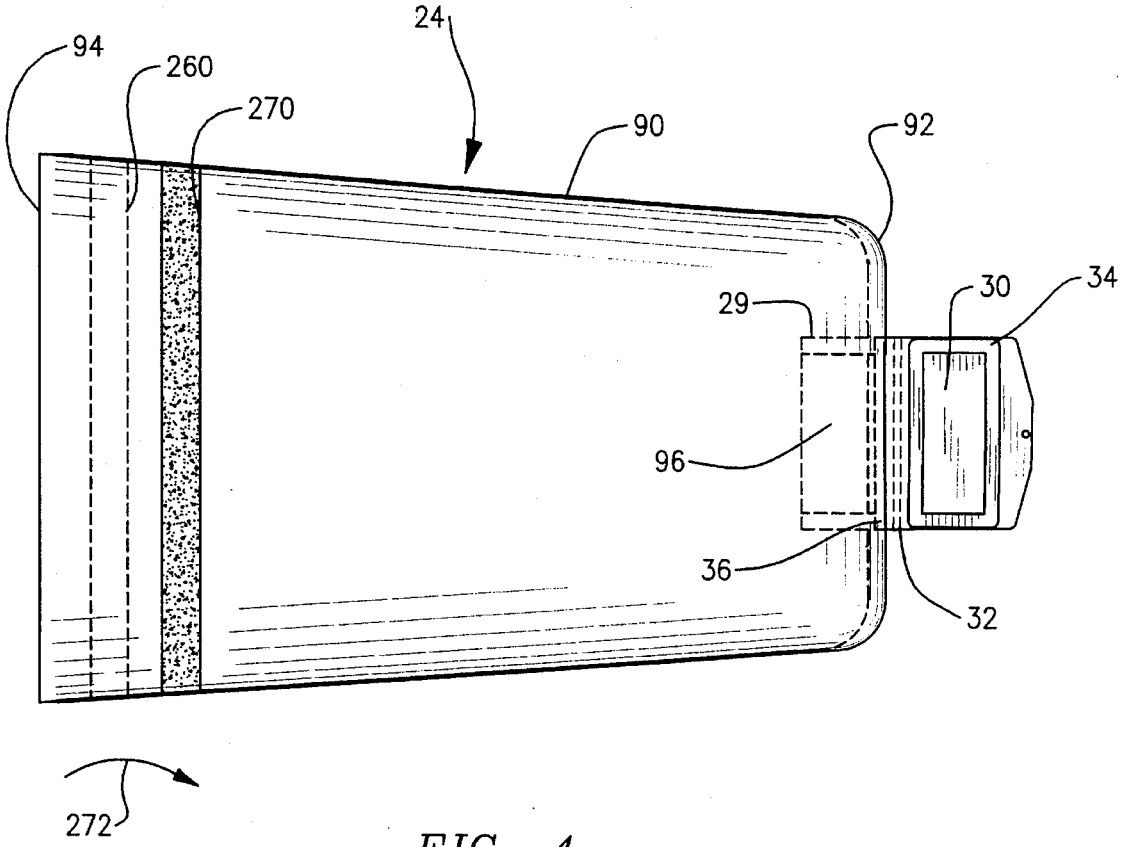
FIG. 4 is an elevational side view of a disposable bag according to this invention.
Figure 5:
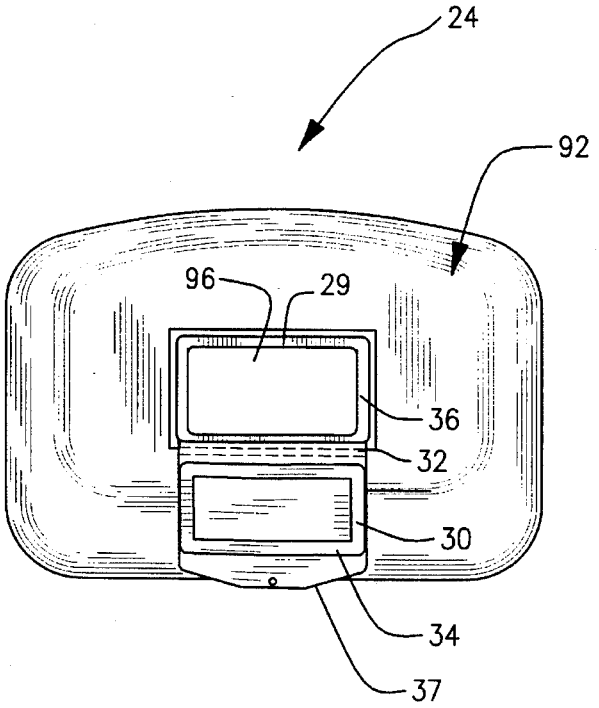
FIG. 5 is an elevational end view of the bag of FIG. 4.

As best shown in FIG. 3, housing 12 includes a pair of resiliently flexible clips 70 and 72 that are received in respective holes 74 and 76 formed in container 18. As a result, the container is detachably engaged with the housing. Housing 12 also includes a fixed wall 78 that is held by supports 80 and 82 beyond the forward end 83 of housing 12 and within chamber 58 of container 18. An O-ring seal 79 extends between wall 78 and the inside wall of canister 22. An elongate, generally rectangular tubular intake section 84 is permanently connected at one end to fixed wall 78 and extends therefrom generally centrally through chamber 58 of container 18. Second port means are formed in intake tube 84. More particularly, such second port means comprise a pair of openings 85 and 87 that are formed in opposite sides of tube 84. Bag element 24, shown alone in FIGS. 4 and 5, is received within canister 22 so that it generally conforms to the interior shape of the canister. Bag element 24 includes an elongate body 90 that generally conforms to the interior shape of canister 22, as shown in FIGS. 2 and 3. The bag element further includes a leading or forward end portion 92 and an open trailing or rearward end portion 94. Leading end portion 92 is shown most clearly in FIG. 5. The body 90 of bag element is typically composed of a flexible, lightweight and yet fairly sturdy waterproof material. Various types of plastic and paper, both treated and untreated, may be utilized. The leading end portion 92 is preferably composed of a relatively rigid plastic that attaches to the flexible fabric of body 90. An opening 96 is formed generally centrally in end portion 92 through mouth element 29. Connecting hinge 32 is typically connected integrally to end portion 92 and cover 30 is attached integrally to the strap. As previously indicated, peripheral rib 34 is selectively engaged with complementary recess 36 to secure cover 30 over opening 96 while the vacuum cleaner is not in use. Cover 30 includes a tab portion 37 that facilitates manipulation of the cover.

As shown in FIGS. 2 and 3, mouth element 29 fits snugly into open leading end 86 of intake tube 84 and engages an annular stop 93 in tube 84. As a result, the leading end 92 of bag element 24 is held securely in place in canister 22. Trailing end 94 of bag 24 is received in an annular recess 100 in canister 22. An annular retaining ring 102 fits within the bag and is seated in recess 100 to hold the trailing end of the bag in an open condition. With the container 18 attached to housing 12 and the bag 24 arranged in the above described condition, the suction tubes 54 and 56 and the intake tube 84 extend through the open trailing end 94 of bag 24 into the interior of the bag.

A closure member 110 is slidably and reciprocally mounted within the apparatus 10. Closure 110 includes a central outer sleeve portion 112 that is slidably mounted on intake tube 84. Sleeve 112 has a generally rectangular cross sectional shape that complements the shape of tube section 84. The central sleeve includes a pair of openings 120 and 122 that may be selectively aligned with openings 85 and 87, respectively, in the manner described more fully below. A pair of O-rings 113 and 115 are disposed between sleeve 112 and intake tube 84 so that the space between those parts is sealed and a proper vacuum is maintained in chamber 58.

A pair of suction tube covers 114 and 116, FIG. 3, are connected to central sleeve 112 by a movable wall 118. Tube cover 114 is slidably mounted on suction tube 54 and cover 116 is similarly mounted on tube 56. Cover 114 includes an opening 124 that is selectively alignable with opening 60 in suction tube 54. Cover 116 has a similar opening 126 that is selectively alignable with the opening 162 in suction tube 56. In FIG. 3, the openings 120, 122, 124 and 126 are not aligned with the first and second port means. As a result, passage between the suction tubes 54 and 56 and the chamber 58 is blocked. Likewise, passage between chamber 58 and intake tube 84 is restricted.

Means are provided for selectively driving closure 110 in a forward direction so that the openings in the suction tube covers align with respective openings in the suction tubes, and the openings in the sleeve 112 align with those in intake tube 84. Such means for driving include a switch assembly 130, FIGS. 2 and 3. Switch assembly 130 includes thumb switch 17, which is slidably mounted on a ramp 132, FIG. 2, on the housing. Thumb switch 17 is connected by a rivet 134, FIGS. 2 and 3, or other suitable means to a pair of laterally spaced apart cam members 136 and 138. The cam members are pivotably mounted on a pivot 140 that is mounted within the housing. Cam members 136 and 138 carry a transverse engagement member 139, FIG. 2, that engages microswitch 50 when the switch assembly is activated, as described more fully below.

Figure 6:
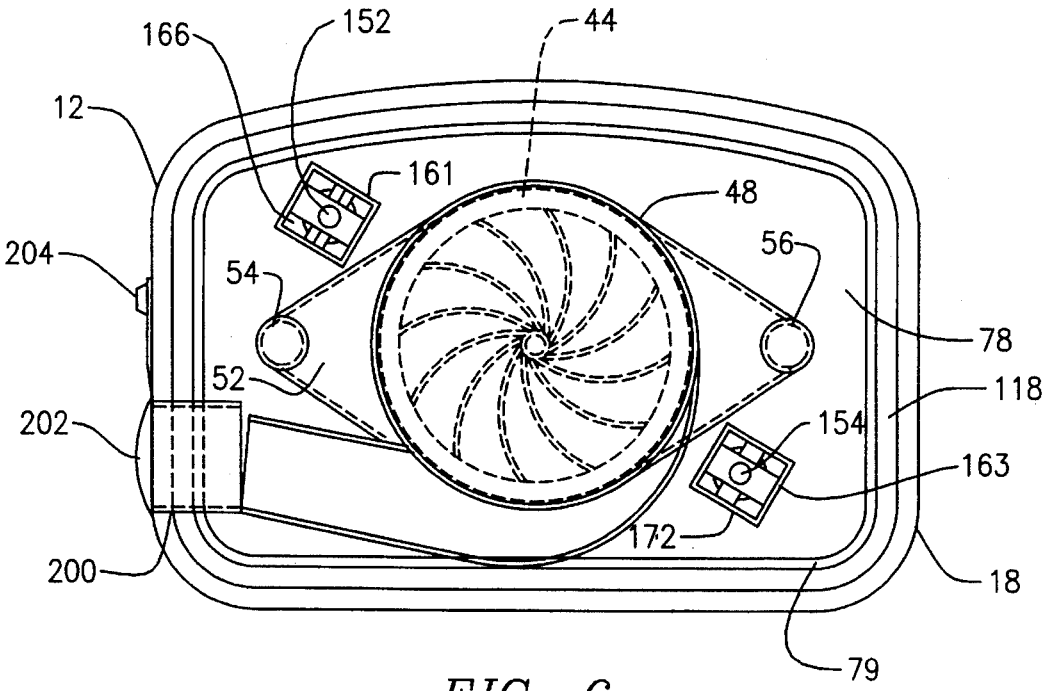
FIG. 6 is a cross sectional view taken along line 6—6 of FIG. 3.

Means are provided for operably interconnecting switch assembly 130 and closure 110. Such means include a cam follower strike plate 142 that is slidably mounted on upper and lower rails 144 and 146, respectively. The side of striker plate 142 that faces away from switch assembly 130 carries a pair of bushings 148 and 150 from which extend respective drive rods 152 and 154. Rods 152 and 154 extend in a generally parallel manner through the housing 12 and are diagonally offset, as shown in FIG. 6. More particularly, rod 152, FIGS. 2 and 3, extends forwardly through a bushing 160 and a fixed wall 162 and contains a ball 164 at its forward end that provisionally, lockably engages a receptacle 166. Similarly, lower drive rod 154 extends through bushing 159 and wall 162 and includes a ball 168 that provisionally and lockably fits into a receptacle 170, FIG. 2. Receptacles 166 and 170 are fixed to movable wall 118 of closure 110. As shown in FIGS. 2, 3, 6 and 7, receptacles 166 and 172 are fixed to the side of wall 118 that faces the blower 42. Openings 161 and 163, FIG. 6, are formed in fixed wall 78 for slidably receiving receptacles 166 and 172, respectively.

A first spring 176 is wound about drive rod 152 between bushings 148 and 160. A second spring 178 is similarly wound around drive rod 154 between bushings 150 and 159. Springs 176 and 178 bias strike plate 142 in the rearward direction of arrow 180 so that rod elements 152 and 154 pull movable wall 118 in a similar direction into the position shown in FIGS. 2 and 3. Springs 176 and 178 also allow strike plate 142 and drive rods 152 and 154 to be driven in the forward direction, represented by arrow 182 so that the closure member 110 is driven in a similar direction. Lock nuts 155 may be adjusted to adjust the position of the rods in the deactivated condition of FIG. 3.

Figure 7:
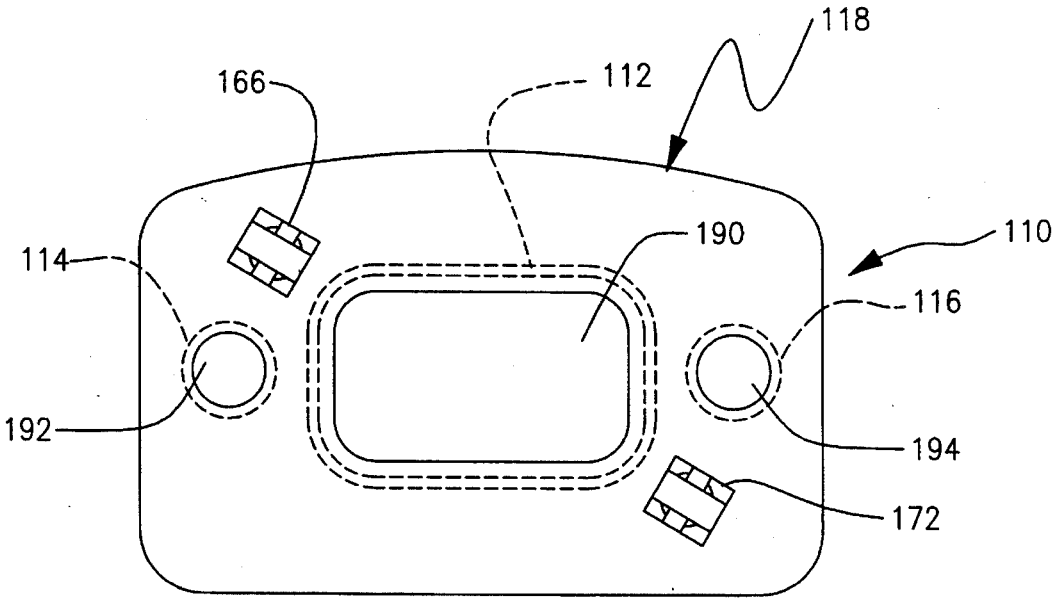
FIG. 7 is an elevational view of the rearwardly facing side of the closure wall.

Movable closure 110 is shown alone in FIG. 7. A generally rectangular central opening 190 for receiving the intake tube 84 is formed in wall 118 and the central sleeve 112 is formed about that opening. A pair of generally circular openings 192 and 194 for receiving suction tubes 54 and 56, respectively, are formed on either side of central opening 112. Tube cover 114 is formed about opening 192 and tube cover 116 is formed about opening 194.

As best shown in FIGS. 3, 6 and 8 an exhaust vent 200 is formed through the wall of housing 12. Vent 200 is communicably connected to the end of volute 48. This vent directs air that is moved by impeller 44 and directed by volute 48 out of the vacuum cleaner 10 and thereby serves as a debris blower. When the vacuum cleaner is energized, a tube, hose or similar means may be engaged with the vent so that dirt or debris may be blown in required direction. Additionally, the apparatus may pump water that is drawn into the volute out of the vent. A cap or cover 202 is pivotably connected to the housing 12 by a pin 204. As shown in FIG. 8, cap 202 is moved out of the way of vent 200 by simply pivoting the cap upwardly. Then, when the vacuum cleaner is no longer in operation, the discharge vent 200 is covered by closing the cap over the vent. If a hose is not required during the operation of the vacuum cleaner, the cover 202 may remain closed and excess pressure is released through elongate vents 206. FIGS. 2 and 3 illustrate apparatus 10 in an "off" condition. Motor 46 is disconnected from power source 40 so that no vacuum is created. At the same time, openings 60 and 62 in suction tubes 54 and 56, respectively, are not aligned with openings 124 and 126 in tube covers 114 and 116. As a result, the first port means are closed and the suction section and the blower means are entirely segregated from the interior of bag 24. Similarly, sleeve openings 120 and 122 are not aligned with intake openings 85 and 87. As a result, the second port means are closed and the intake tube 84 and the inlet portion 28 are also segregated from the inside of the bag 24. Debris can neither enter nor leave the bag. It cannot enter the moving parts of the vacuum cleaner and cannot enter or exit through the vacuum cleaner inlet 28 because all of the openings are blocked by the closure 110.

Before the vacuum cleaner is operated, the user may wish to insert a fresh bag 24. This is accomplished by pressing clips 70 and 72 so that canister 22 is disengaged from housing 12. The lock ring 102 is removed from recess 100 and the old bag is removed and discarded. A fresh bag is then replaced in the manner shown, with mouth element 93 engaging the open outer end 86 of intake tube 84. The lock ring is replaced in the recess to hold the bag open and in place in the canister.

The vacuum cleaner 10 is activated by engaging thumb switch 17 and moving it in the direction of arrow 15 into the activated condition shown in FIGS. 1 and 2. In this condition, engagement member 139 engages power switch 50, which connects power source 40 to the blower means 42 so that the apparatus is energized. At the same time, cam members 136 and 138 pivot about member 140 so that the cam members drive strike plate 142 forwardly in the direction of arrow 182. This urges drive rods 152 and 154 in the similar forward direction, compressing springs 176 and 178 and urging closure 110 forwardly into the position shown in FIGS. 9 and 10. This causes tube cover openings 124 and 126 to align with suction tube openings 60 and 62, respectively. It also causes sleeve openings 120 and 122 to align with intake tube openings 85 and 87, respectively. Impeller 44 rotates to generate a suction in section 52. Because suction tubes 54 and 56 now communicate with the interior of bag 24, a vacuum is created within the bag. Likewise, intake tube 84 communicates with the interior of bag 24 through the aligned openings in the sleeve 112. As a result, air and accompanying debris and/or liquids are drawn in through inlet 28 and intake tube 84 into the bag 24.

Accordingly, by urging the switch assembly into the condition shown in FIGS. 9 and 10, the apparatus is activated and the bag is simultaneously opened both to the moving parts so that a suction is created in the bag and to the outside so that particulate and liquid debris can be collected. The vacuuming operation may then be continued for as long as required.

A number of features enhance the operation of the apparatus. For example, O-rings 113 and 115 help to seal the space between sleeve 112 and intake tube 84, and thus help to maintain the vacuum in the bag. Likewise, the O-ring 79 prevents a loss of vacuum through the housing 12. This O-ring and the placement of the openings in the suction tubes allows apparatus 10 to be manipulated in various directions without hindering use of the device. If the apparatus is pointed upwardly, debris and liquid fall toward the rearward portion of the container 18 but do not enter the housing or interfere with the motor or other moving parts. Liquid drawn into the volute 48 through suction openings 60 and 62 is pumped out through vent 200.

The filters 64 and 66 in suction tubes 54 and 56, respectively, screen particulate matter that may be drawn in through the aligned openings in the suction tubes and suction tube covers. Each of the suction tubes 54 and 56 includes an outer end 55 that is releasably attached to the inner end of the tube, such as by threads or a snap fitting. This allows the suction tubes to be disassembled so that the filters may be periodically replaced. This operation is performed by disattaching the canister, sliding the movable closure 110 forwardly to remove it from the intake tube 84 and suction tubes 54 and 56, and then removing the distal ends 55 of tubes 54 and 56. The filters may then be conveniently removed and replaced.

The openings in the suction tubes and suction tube covers are not aligned with the openings in the sleeve and intake tube. This minimizes the possibility that suction created by the suction tube will interfere with the airflow through the intake tube.

As illustrated in FIGS. 1, 2 and 9, thumb switch 17 includes a locking pin 250. When the thumb switch is moved into the activated state, shown in FIG. 9, locking pin 250 is inserted into a complementary provisional locking receptacle 252 that is formed on the top of the housing. As a result, thumb switch 17 and switch assembly 130 are held in the activated condition, against the spring bias of springs 176 and 178. The material that forms pin 250 and receptacle 252 is somewhat resilient so that a snap fit is provided between these parts. To deactivate the apparatus, thumb switch 17 is engaged, locking pin 250 is pulled out of receptacle 252 and the switch assembly is allowed to return to the deactivated condition shown in FIGS. 2 and 3. Power switch 50 is disconnected so that the blower is turned off and the openings in the suction tube covers and sleeve are offset from the respective openings in the suction tubes and intake tube. As a result, the openings into the bag are closed as soon as the blower is de-energized and the bag is again segregated both from the moving parts of the vacuum cleaner and the inlet. Canister may then be disengaged from housing 12 and the bag may be removed and discarded.

As indicated in FIG. 4, the bag may include an adhesive strip 260 on its inside surface. When the bag is removed, a conventional backing strip is removed from adhesive strip 260 and the bag is sealed closed. Additionally, an adhesive strip 270 may be employed on the outside surface of the bag. When the bag is removed, the rearward end portion 94 is folded over in the direction of arrow 272 and a backing is removed from adhesive strip 270 so that the trailing portion of the bag may be engaged with adhesive strip 270. This seals the bag closed and prevents debris from spilling out of the bag as it is discarded. Between uses of the apparatus 10, the inlet 28 is covered by folding closure 30 over opening 96 and engaging rib 34 the closure with the recess 96, as previously described.

In an alternative embodiment, FIG. 11, a permanent canister **22*a* may be employed without the use of a disposable bag. In this example, canister 22*a* has a slot 26*a*. In order to close the slot between uses, an adapter 280 is employed. Adapter 280 includes a mouth element 282 that is received through slot 26*a* and engages the outer open end 86*a* of intake tube 84*a***.

Mouth element 282 includes an opening 283 therethrough that defines an inlet into the canister. Again, a closure 284 may be attached to adapter 280 by a flexible hinge. Between uses of the device, closure 284 is engaged with a recess 286 in adapter 280 so that the inlet opening 282 through the adapter and into the intake tube is covered. When the vacuum cleaner is in use, as shown, the cover is stored in an indent 288 in the bottom of the canister.

Each of the elements of apparatus 10 may be constructed from various durable and yet preferably lightweight materials that are used for vacuum cleaners and similar mechanisms.

Accordingly, the present invention provides for a convenient, hand-held, wet-dry vacuum cleaner that overcomes a number of the problems of conventional vacuum cleaner. Because a bag is employed, the problems associated with cleaning canisters have been eliminated. And, because the bag remains segregated from the moving parts and the outside between uses, a number of benefits are provided. In particular, rusting and fouling of the moving parts is minimized, the spilling of debris is significantly reduced and the collection and colonization of insects and bacteria in the vacuum cleaner is virtually eliminated.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A vacuum cleaner apparatus comprising:

a housing;

blower means disposed in said housing;

means defining a source of power for driving said blower means;

substance collection container means that are detachably engaged with said housing and include an inlet portion formed therein;

a suction section that extends generally between said blower means and said substance collection container means, said suction section including first port means that are disposed in said container means;

an intake section that is engageable with said inlet portion of said container means and includes second port means that are disposed in said container means; and actuator means for selectively connecting said blower means with said power source to operate said blower means and opening said first and second port means to create a vacuum in said container means such that air and accompanying substances are drawn through said intake section into said container, and for selectively disconnecting said blower means from said power source and closing said first and second port means to terminate airflow and restrict substance movement into and out of said container means.

2. The apparatus of claim 1 in which said power source includes battery means disposed in said housing.

3. The apparatus of claim 1 in which said blower means include an impeller and a motor that is energized by said power source to drive said impeller to create said vacuum in said container means.

4. The apparatus of claim 1 in which said container means include a canister having a rearward end that is detachably engageable with said housing and a forward end through which said inlet portion is formed.

5. The apparatus of claim 4 in which said container means further include a bag element that is removably received by said canister.

6. The apparatus of claim 5 in which said bag element includes a mouth element formed in and extending through a forward end of said bag and defining at least a part of said inlet portion, said mouth element being releasably engageable with said intake section.

7. The apparatus of claim 6 in which said container means further include cover means attached to said mouth element and extending out of said canister through said inlet for selectively covering and uncovering said inlet portion.

8. The apparatus of claim 5 further including a retaining element for engaging a relatively rearward end of said bag to hold said bag generally open within said canister.

9. The apparatus of claim 4 in which said container means includes an adapter piece that engages said canister and includes a mouth element through which said inlet portion is formed, said adapter including cover means flexibly attached thereto for selectively covering and uncovering said inlet portion.

10. The apparatus of claim 1 in which said suction section includes at least one inner suction tube that extends into said container means, said first port means including an orifice formed in said inner suction tube.

11. The apparatus of claim 1 in which said suction section includes filter means for collecting solid substances that enter said suction section through said first port means from said container means.

12. The apparatus of claim 1 in which said actuator means include a closure member that is slidably mounted on said intake section and said suction section, and means for driving said closure member between a first position covering said first and second port means and a second position uncovering said first and second port means.

13. The apparatus of claim 12 in which said means for driving includes a switch assembly and means for operably connecting said switch assembly and said closure, said switch assembly being alternately movable between a first state to urge said closure into said first position and a second state to urge said closure into said second position.

14. The apparatus of claim 13 in which said means for operably connecting include resilient means for biasing said switch assembly into said first state and allowing said switch assembly to be moved into said second state.

15. The apparatus of claim 13 in which said switch assembly includes cam means and said means for operably connecting include cam follower means that are engaged by said cam means.

16. The apparatus of claim 13 further including means for provisionally locking said switch assembly in said second state.

17. The apparatus of claim 13 further including a power switch switchably interconnected between said power source and said blower means and in which said switch assembly includes an engagement member for engaging said power switch when said switch assembly is in said first state to connect said power source and said blower means and disengaging said power switch when said switch assembly is in said second state to disconnect said power source and said blower means.

18. The apparatus of claim 1 further including an exhaust vent that extends from said blower means through said housing for exhausting air drawn by said blower means when said blower means are operated.

19. A substance collection bag for use with a hand-held vacuum cleaner apparatus having a housing, a selectively activated blower, a canister that is detachably engaged with the housing and has an inlet formed therein, and a suction section interconnecting the blower means and the canister for developing a vacuum in the canister to draw air and debris in through said inlet when said blower means are activated, said bag comprising:

a bag body that is adapted to be received by and generally conforms to the interior shape of said canister;

a leading end portion that includes a first opening that is adapted to communicate with said inlet of said canister;

a trailing end portion that includes a second opening that is adapted to communicate with said suction section such that a vacuum is created in said bag when said blower means is activated; and a cover flexibly connected to said leading portion for selectively covering and uncovering said first opening and said inlet.

* * * * *